US005291260A

United States Patent [19]

Johnson et al.

[11] Patent Number: 5,291,260

[45] Date of Patent: Mar. 1, 1994

[54] IMAGE FORMING APPARATUS HAVING A TRANSFER DRUM WITH A VACUUM SHEET HOLDING MECHANISM

[75] Inventors: Kevin M. Johnson, Rochester; Dwight J. Petruchik, Rush, both of N.Y.

[73] Assignee: Eastman Kodak Company, Rochester, N.Y.

[21] Appl. No.: 984,803

[22] Filed: Dec. 3, 1992

[51] Int. Cl.[5] ..... G03G 21/00

[52] U.S. Cl. ..... 355/312; 355/271; 355/279; 271/196; 271/276

[58] Field of Search ..... 355/271, 279, 312; 271/194, 196, 276

[56] References Cited

U.S. PATENT DOCUMENTS

| | | | |
|---|---|---|---|
| 4,927,727 | 5/1990 | Rimai et al. | 430/99 |
| 4,941,020 | 7/1990 | Baughman et al. | 355/275 |
| 4,949,129 | 8/1990 | Fowlkes et al. | 355/274 |
| 4,968,578 | 11/1990 | Light et al. | 430/126 |
| 4,982,207 | 1/1991 | Tunmore et al. | 271/196 X |
| 4,994,827 | 2/1991 | Jamzadeh et al. | 346/157 |
| 5,006,900 | 4/1991 | Baughman et al. | 355/271 |
| 5,016,056 | 5/1991 | Johnson et al. | 355/279 |
| 5,043,761 | 8/1991 | Johnson | 355/326 |
| 5,060,931 | 10/1991 | Morita | 271/276 |
| 5,061,590 | 10/1991 | Johnson et al. | 430/126 |
| 5,072,922 | 12/1991 | Paulson | 271/276 X |
| 5,155,535 | 10/1992 | Bermel et al. | 355/312 X |

*Primary Examiner*—Benjamin R. Fuller
*Assistant Examiner*—J. E. Barlow, Jr.
*Attorney, Agent, or Firm*—Leonard W. Treash

[57] ABSTRACT

An image forming apparatus in which toner images are transferred using a combination of heat and pressure to a receiving sheet includes a transfer drum with a vacuum holding means for the receiving sheet. To prevent a loss of nip pressure over vacuum holes, the drum is formed of a metallic core with a slot running generally parallel to the core's axis of rotation. A thin metallic sheet is positioned around the core, which sheet has very thin slots running across the slot in the core. A vacuum is applied to the core slot which communicates through the sheet slots to hold a receiving sheet to the outside surface of the metallic sheet.

15 Claims, 2 Drawing Sheets

IMAGE FORMING APPARATUS HAVING A TRANSFER DRUM WITH A VACUUM SHEET HOLDING MECHANISM

This invention relates to an image forming apparatus in which a transfer drum is used to move a receiving sheet through transfer relation with a toner image. More specifically, it relates to a vacuum hold-down structure for such a transfer drum. Although not limited thereto, it is particularly usable in image forming apparatus in which transfer is accomplished, at least in part, by a combination of heat and pressure.

U.S. Pat. Nos. 4,968,578; 4,927,727 and 4,994,827 describe a process of transferring toner images from a photoconductor or other image member to a receiving sheet in which the receiving sheet is heated to a temperature sufficient to sinter or soften the toner at least where it contacts the receiving sheet and where the toner particles contact each other. This process is particularly usable with extremely small toner particles, for example, particles having an average diameter of less than 5 microns, but it is also usable with larger size particles. It can be used for transfer to all types of receiving surface. However, for highest quality images, the receiving sheet has an outer layer which is heat softenable and assists in the transfer of the first layer of toner. The heat softenable layer also assists in providing a uniform gloss to the final image. U.S. Pat. No. 5,061,590 shows an internally heated transfer drum which is metallic throughout to provide good control of the temperature of the receiving sheet in a heat-assisted transfer process.

Receiving sheets are typically held to transfer drums or belts by vacuum, gripping fingers or electrostatics or a combination of some of these. Gripping fingers require that the image not extend to the edge of the sheet. Electrostatics is effective for relatively thin sheets, but may not hold the transfer sheet tight enough (especially if the transfer sheet is relatively thick) to prevent movement and lack of registration if color images are being formed.

It is obviously desirable to be able to create an image to the edge of the sheet to eliminate the necessity for cropping images as part of the finishing process.

U.S. Pat. Nos. 4,941,020; 4,949,129; 5,006,900 and 5,155,535, all deal with a problem of using vacuum holes to hold a receiving sheet for electrostatic transfer. Each reference deals with various solutions that maintain electrical transfer field continuity so that toner will be transferred to a receiving sheet portion overlying a vacuum hole.

U.S. Pat. Nos. 5,043,761 and 5,016,056 show vacuum holddowns for receiving sheets to transfer drums usable in a thermally assisted transfer process. However, in these structures, imaging is not done over the portion of the sheet overlying the vacuum holes. Note that in U.S. Pat. No. 5,016,056 the vacuum holes are, in fact, elongated slots parallel to the axis of the drum.

Although some solutions may apply to both, the problems associated with transferring a toner image to a receiving sheet positioned over vacuum holes is somewhat different between electrostatic transfer and heat-pressure transfer. In the heat-pressure transfer process, referred to above, a lack of transfer occurs as a result of a slight separation of the receiving sheet into the vacuum hole and away from the toner image. This may not, in fact, appear as an actual separation but rather as a loss of a certain amount of pressure which may be desirable for complete heat transfer.

We have found that with vacuum holes having a circular corss-section, a noticeable loss of pressure and, therefore, loss of image transfer occurs. Reducing the size of the hole to a point that the defect is not visible does not provide enough holding force for thick sheets.

SUMMARY OF THE INVENTION

It is an object of the invention to provide an image forming apparatus in which a toner image is transferred to a receiving sheet, which receiving sheet is held to a transfer member by a vacuum but in which problems associated with transfer of a toner image to the portion of the sheet overlying vacuum holes are greatly reduced or eliminated.

This and other objects are accomplished by an image forming apparatus in which a transfer member having an axis of rotation and a receiving sheet holding surface includes a core having a core slot running generally across the direction of movement of a toner image to be transferred. A thin sheet is positioned around the core and defines the receiving sheet holding surface. The thin sheet has a plurality of narrow sheet slots running in the direction of movement of the toner image to be transferred, across the core slot and in overlying vacuum communication with the core slot. Means for applying a vacuum to the core slot forms a vacuum through the core slot and the sheet slots to hold the receiving sheet to the receiving sheet holding surface.

According to a preferred embodiment, the transfer member is a transfer drum having a metallic core which is internally heated. Transfer is accomplished by a combination of heat and pressure. The thin sheet is a thin metallic sheet which provides good heat conductivity between the core and the receiving sheet.

We have found that an adequate holding force can be applied to a relatively thick receiving sheet through slots that are sufficiently thin that pressure is not operatively lost over them. Thus, the invention permits imaging to the edge of a sheet, or at least, over the vacuum slots.

Preferably, the metallic sheet is less than 0.25 mm in thickness. For example, it can be a sheet of stainless steel having a thickness of 0.15 mm. The sheet slots are preferably also less than 0.25 mm across, for example, 0.17 mm. The length of the slots is not critical but, for best holding force, they are preferably 5 mm in length or greater.

DESCRIPTION OF THE PREFERRED EMBODIMENTS

Figure 1:
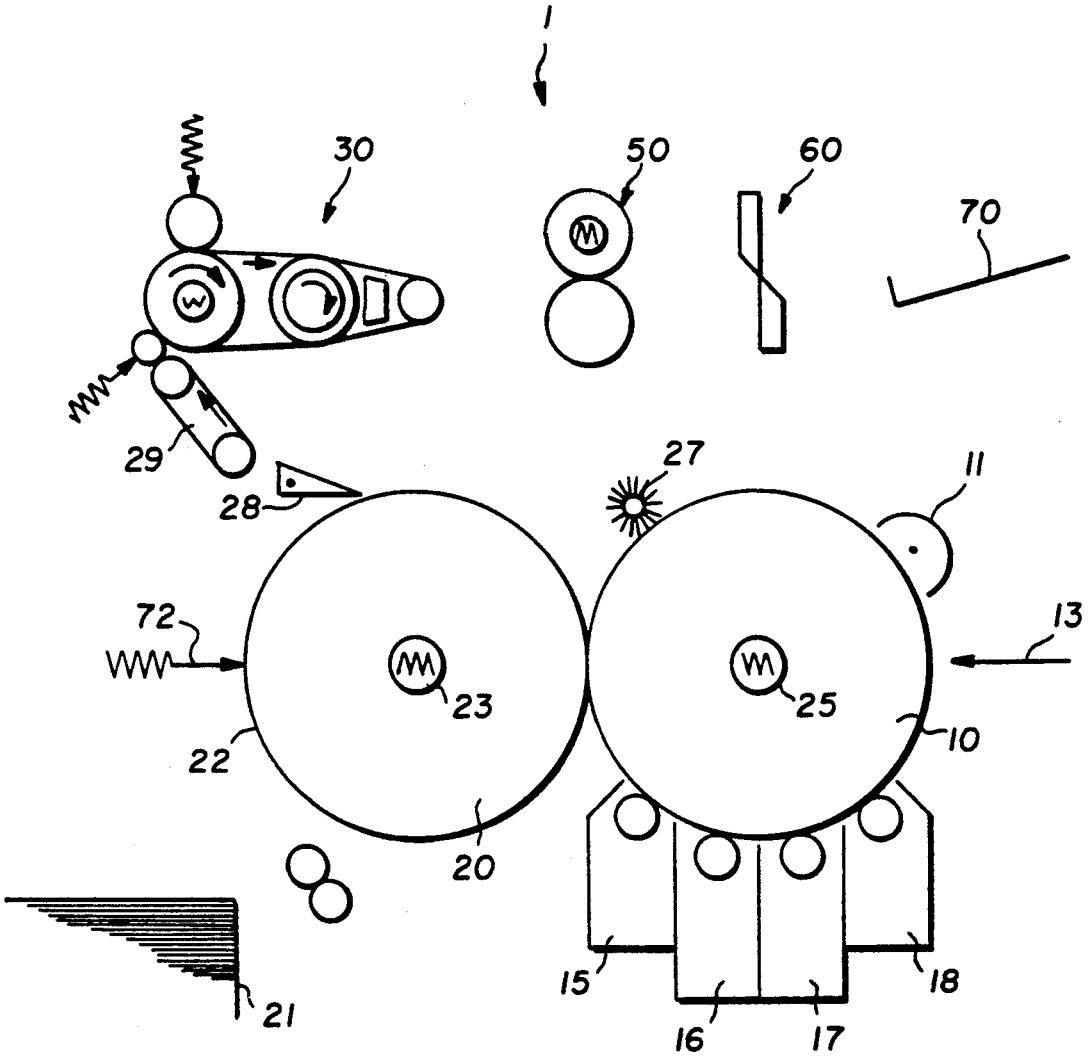
FIG. 1 is a front schematic of an image forming apparatus.

Referring to FIG. 1, an image forming apparatus 1 includes an image member, for example, a photoconductive drum 10 which is internally mildly heated by a lamp 25 and is rotatable past a series of stations to create toner images on a peripheral surface. In operation, the peripheral surface of drum 10 passes a charging station 11 where it is uniformly charged. The uniformly charged surface is imagewise exposed, for example, by a laser 13 to create a series of electrostatic images. Each image of the series of electrostatic images are toned by applying toner from one of toning stations 15, 16, 17 and 18, each of which stations contain a different color toner, to create a series of different color toner images. The different color toner images are transferred in registration to a receiving sheet fed from a receiving sheet supply 21 onto a transfer sheet receiving surface 22 of a transfer drum 20 to form a multicolor image on the receiving sheet. The peripheral surface of image member 10 is cleaned by a cleaning device 27.

After the multicolor image has been formed on the receiving sheet, a pawl 28 is moved into a position to separate the receiving sheet from the receiving sheet holding surface 22. The receiving sheet is directed by a transport 29 to a fuser 30 where the multicolor image is fixed to the receiving sheet. The receiving sheet can then pass through additional finishing stations including a texturizing station 50 and a cutter 60 and, ultimately, to an output tray 70.

The transfer of the toner images from the periphery of image member 10 is accomplished by a combination of heat and pressure in a transfer nip. Although the receiving sheet can be ordinary bond or finished paper, highest quality images are formed and transfer is assisted if its outside layer is heat softenable.

Figure 2:
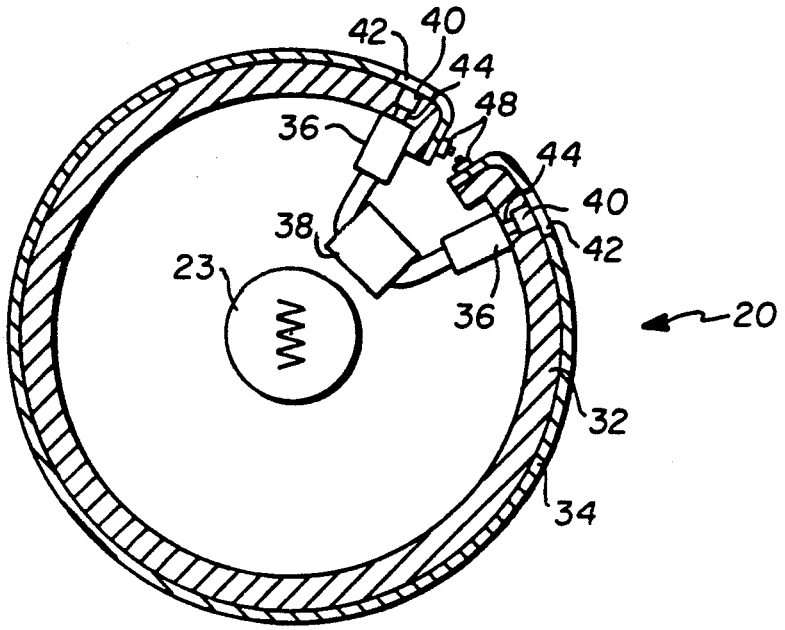
FIG. 2 is a front section of a transfer drum.
Figure 3:
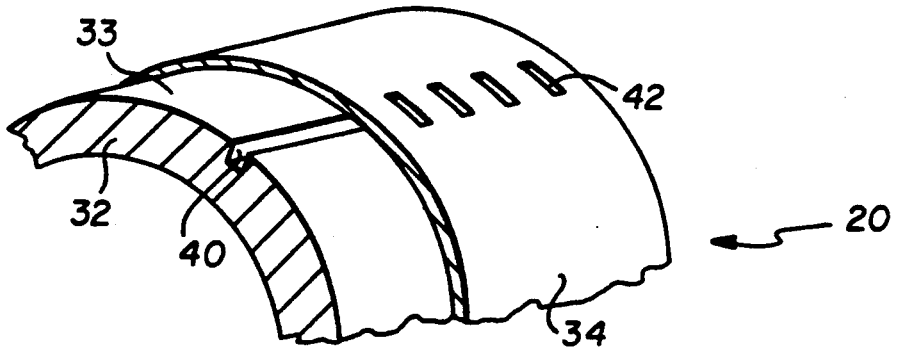
FIG. 3 is a perspective view of the transfer drum shown in FIG. 2 with portions broken away for clarity of illustration.

The receiving sheet is fed from receiving sheet supply 21 onto the receiving sheet holding surface 22 and gripped there by a vacuum means, described more thoroughly with respect to FIGS. 2 and 3. As the receiving sheet passes through transfer nip 25, it is subjected to pressure from a pressure applying means 72, preferably in excess of 100 psi. For some materials and apparatus, the pressure in the nip may desirably be much higher than 100 psi, for example, as high as 500–1000 psi. The receiving sheet is heated to a temperature of around 100° C. When it contacts toner on the peripheral surface of drum 10, it immediately heats the toner to a point at which the toner sinters where in contact with other toner particles and also where in contact with the receiving sheet. If the receiving sheet has a heat softenable layer, the toner particles partially imbed in the heat softenable layer and adhere to it. Thus, transfer is accomplished by a combination of heat and pressure. For more details of this process, see the above cited U.S. Pat. No. 5,061,590 and U.S. Pat. No. 4,927,727, both of which are hereby incorporated by reference herein.

To avoid the necessity of later trimming borders, it is desirable to image to the edge of a receiving sheet. It is also desirable to hold a relatively thick receiving sheet utilizing a vacuum. This requires some mechanism be found to maintain pressure between the receiving sheet and the toner image where the receiving sheet overlies vacuum holes.

Referring to FIGS. 2 and 3, details of transfer drum 20 are illustrated. According to FIG. 2, transfer drum 20 includes a metallic, for example, aluminum, core 32 surrounding a heating lamp 23. Core 32 includes an outside cylindrical core surface 33 which includes two core slots 40 running generally parallel to the axis of rotation of drum 20 and across the path of the toner images being transferred. Each of core slots 40 forms part of a vacuum plenum and is connected to a source 38 of vacuum through a suitable connecting means 36 and 44. Although connecting means 36 and 44 and vacuum source 38 are shown inside drum 20 in FIG. 2, for ease and clarity of illustration, they are preferably located outside drum 20 so that they do not interfere with the heating of core 32 by lamp 23.

A thin metallic sheet 34 is stretched around surface 33 of core 32 and fastened by suitable clamps 48. Sheet 34 is preferably metallic, for example, stainless steel. It is preferably less than 0.25 mm in thickness. The dimensions of slot 40 are not critical. For example, it can be 1.50 mm wide and deep.

The thin sheet 34 has narrow elongated slots formed in it which are positioned directly over core slot 40. As best seen in FIG. 3, sheet slots 42 run generally in a direction parallel to the path of travel of images being transferred and across core slot 40. They are quite thin across, for example, less than 0.25 mm, for example, 0.17 mm across. The length of the slots is not critical but they should be long enough to communicate easily with core slot 40, for example, 5 mm in length or more and long enough to firmly hold the receiving sheet.

In operation, a vacuum is applied to core slot 40 which communicates through narrow sheet slots 42 to hold a receiving sheet to the outside surface of sheet 34, which surface becomes the receiving sheet holding surface 22 of drum 20.

We have found that with a large number of fairly lengthy and very thin slots in a very thin sheet, reasonably high holding force can be maintained without a substantial loss in nip pressure. Because the pressure is substantially maintained, the slots are not visible as lines in the image. The number of slots is, in part, determined by the thickness of the receiving sheets to be handled and the holding force necessary. For example, we have found that two sheet slots per linear millimeter across the entire receiving sheet, which slots are 0.17 mm in thickness and 9 mm long will provide adequate holding force for 0.22 mm thick paper stock having the look and feel of a photographic print. This appears to work despite the fact that holes having a circular cross-section of a diameter sufficient to hold a similar sheet will not maintain adequate pressure and show up as small blemishes in the image where toner has not transferred.

The thin sheet slots 42 can be formed as follows. A stainless sheet having a thickness of 0.15 mm is cleaned and a photoresist is applied to one surface of it. The photoresist is exposed to a target having a series of lines 0.17 mm across and 9 mm in length. The photoresist is developed washing away the material that is exposed and leaving those portions that were not exposed. The stainless steel is etched by a suitable etching material providing slots that are also approximately 0.17 mm across and 9 mm in length. The rest of the photoresist is removed using a suitable solvent. Very thin slots are formed in a very thin stainless steel sheet in this manner. These slots can pass a vacuum without reducing nip pressure in the apparatus shown in FIG. 1 to a point that toner transfer is visibly reduced, that is, to a point that a visible image defect is created.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus comprising:

an endless image member movable through a path, means for forming a toner image on the image member, a rotatable transfer drum having an axis of rotation and a receiving sheet holding surface positioned to form a pressure nip with said image member, vacuum means for holding a receiving sheet to said image sheet holding surface, means for heating said transfer drum sufficiently to transfer said toner image to said receiving sheet in said transfer nip, characterized in that said transfer drum includes, a metallic core having an outside cylindrical core surface and a core slot in said core surface running generally parallel to said axis of rotation, a thin heat conductive metallic sheet fastened to said core surface and having a series of sheet slots perpendicular to and in vacuum communication with said core slot and less than 0.25 mm across, the surface of said conductive sheet facing away from said core defining the receiving sheet holding surface of said drum, and means connecting said vacuum means to said core slot to apply a vacuum through said sheet slots to hold a receiving sheet to said receiving sheet holding surface.

2. Image forming apparatus according to claim 1 wherein said heat conductive sheet is less than 0.25 mm in thickness.

3. Image forming apparatus according to claim 2 wherein said heat conductive sheet is 0.15 mm in thickness.

4. Image forming apparatus according to claim 1 wherein said sheet slots are more than 5 mm in length.

5. Image forming apparatus according to claim 1 wherein said heat conductive sheet includes a line of sheet slots at a concentration of at least two sheet slots to a millimeter.

6. An image forming apparatus comprising a transfer member having a receiving sheet holding surface, said transfer member including a core having a slot running in a first direction and a metallic sheet attached to said core and having a surface defining the transfer sheet receiving surface and a plurality of sheet slots, not more than 0.25 mm across, positioned generally across the core slot and communicating with the core slot, and means for applying a vacuum to the core slot to hold a receiving sheet to said receiving sheet holding surface through said sheet slots.

7. Image forming apparatus according to claim 6 wherein the core and thin sheet are both metallic and the thin sheet is not more than 0.25 mm in thickness.

8. Image forming apparatus according to claim 7 wherein the sheet slot are at least 5 mm in length.

9. Image forming apparatus comprising:

a photoconductive drum movable through a path, means for forming a series of different color toner images on said photoconductive drum, a rotatable transfer drum having an axis of rotation and a receiving sheet holding surface, said drum being positioned to form a pressure nip between a receiving sheet held on said surface and said photoconductive drum to transfer said toner images in registration to a receiving sheet so held to create a multicolor image on said receiving sheet, vacuum means for holding a receiving sheet to the receiving sheet holding surface of said transfer drum, and means for heating said transfer drum and for applying sufficient pressure in said nip to transfer said toner images to said receiving sheet, characterized in that said transfer drum includes, a metallic core having a core slot running generally parallel to the axis of rotation, a thin metallic sheet fastened to said core and having a series of sheet slots not more than 0.25 mm across and running across and in vacuum communiction with said core slot, the surface of said metallic sheet facing away from said core defining the receiving sheet holding surface of said drum, means connecting said vacuum means to said core slot to apply a vacuum through said sheet slots to hold a receiving sheet to said receiving sheet holding surface, and said metallic sheet being sufficiently thin and said core slots being sufficiently thin and long that there is sufficient nip pressure over said cover slots to sufficiently transfer said image that no visible image defect occurs because of said core slots.

10. Image forming apparatus according to claim 9 wherein said thin sheet is not more than 0.25 mm thick and said sheet slots are at least 5 mm in length.

11. Image forming apparatus according to claim 9 wherein said sheet slots have been manufactured by an etching process using a photoresist as a mask.

12. A transfer drum for an image forming apparatus, said transfer drum comprising:

a metallic core having an outside cylindrical core surface and an axis of rotation, a core slot in said outside cylindrical core surface running parallel to the axis of rotation, and a thin metallic sheet fastened to said outside cylindrical core surface and having a series of sheet slots, not more than 0.25 mm across, positioned across said core slot and in vacuum communication with said core slot.

13. A transfer drum according to claim 12 wherein said thin metallic sheet is not more than 0.25 mm in thickness and said sheets slots are at least 5 mm in length.

14. Image forming apparatus comprising:

an endless image member movable through a path, means for forming a toner image on the image member, a rotatable transfer drum having an axis of rotation and a receiving sheet holding surface positioned to form a pressure nip with said image member, vacuum means for holding a receiving sheet to said image sheet holding surface, means for heating said transfer drum sufficiently to transfer said toner image to said receiving sheet in said transfer nip, characterized in that said transfer drum includes, a metallic core having an outside cylindrical core surface and a core slot in said core surface running generally parallel to said axis of rotation, a thin heat conductive metallic sheet fastened to said core surface and having a series of sheet slots perpendicular to and in vacuum communication with said core slot and more than 5 mm in length, the surface of said conductive sheet facing away from said core defining the receiving sheet holding surface of said drum, and means connecting said vacuum means to said core slot to apply a vacuum through said sheet slots to hold a receiving sheet to said receiving sheet holding surface.

15. Image forming apparatus comprising:

an endless image member movable through a path, means for forming a toner image on the image member, a rotatable transfer drum having an axis of rotation and a receiving sheet holding surface positioned to form a pressure nip with said image member, vacuum means for holding a receiving sheet to said image sheet holding surface, means for heating said transfer drum sufficiently to transfer said toner image to said receiving sheet in said transfer nip, characterized in that said transfer drum includes, a metallic core having an outside cylindrical core surface and a core slot in said core surface running generally parallel to said axis of rotation, a thin heat conductive metallic sheet fastened to said core surface and having a series of sheet slots perpendicular to and in vacuum communication with said core slot, said sheet slots being at a concentration of at least two sheet slots to a millimeter measured parallel to the axis of rotation of the drum, the surface of said conductive sheet facing away from said core defining the receiving sheet holding surface of said drum, and means connecting said vacuum means to said core slot to apply a vacuum through said sheet slots to hold a receiving sheet to said receiving sheet holding surface.

* * * * *